US010940982B1

(12) United States Patent
Lei

(10) Patent No.: US 10,940,982 B1
(45) Date of Patent: Mar. 9, 2021

(54) CONTAINER WITH SECURITY LOCK

(71) Applicant: Jing Lei, Dongguan (CN)

(72) Inventor: Jing Lei, Dongguan (CN)

(73) Assignee: Dongguan LK Tin Packaging Co., Ltd., Dongguan (CN)

( * ) Notice: Subject to any disclaimer, the term of this patent is extended or adjusted under 35 U.S.C. 154(b) by 12 days.

(21) Appl. No.: 16/563,646

(22) Filed: Sep. 6, 2019

(51) Int. Cl.
*B65D 50/04* (2006.01)

(52) U.S. Cl.
CPC ..... *B65D 50/048* (2013.01)

(58) Field of Classification Search
CPC .. B65D 50/046; B65D 50/041; B65D 50/048; B65D 50/045; B65D 51/24; B65D 45/22; B65D 45/16; B65D 45/32
USPC ..... 220/254.8, 259.3, 256.1, 326, 324, 315, 220/319, 212, 230; 215/220, 219, 217, 215/228
See application file for complete search history.

(56) References Cited

U.S. PATENT DOCUMENTS 2,676,845 A * 4/1954 Rathsprecher ..... A61M 11/00 239/354
2,847,139 A * 8/1958 Bror ..... B65D 50/041 215/220
3,830,390 A * 8/1974 Gach ..... B65D 50/041 215/220
5,957,313 A * 9/1999 Bouan ..... B65D 45/32 215/215
6,213,323 B1 * 4/2001 Ferrari ..... B65D 45/22 215/272
8,931,657 B2 * 1/2015 Kientzle ..... B65D 50/046 220/345.3
9,187,220 B2 * 11/2015 Biesecker ..... B65D 43/0212
9,481,496 B2 * 11/2016 Cottle ..... B65D 50/046

* cited by examiner

*Primary Examiner* — Robert J Hicks
(74) *Attorney, Agent, or Firm* — Justin Lampel

(57) ABSTRACT

A container with a security lock is provided. The container may have a lid (or "top") portion and a bottom portion. The lid portion may have an exterior cover and a bottom ring which are separated by a compression spring. Once extended protrusions on both the exterior cover and bottom ring of the lid are vertically aligned, a specific pressing and then twisting motion must be used to separate the lid from the bottom portion to gain access to the interior of the container. The bottom portion may receive contents such as medication which may be securely stored and protected from children who might otherwise access an unprotected and unsecured container.

13 Claims, 9 Drawing Sheets

CONTAINER WITH SECURITY LOCK

BACKGROUND OF THE INVENTION

A container with a security lock is provided. The container may have a lid (or "top") portion and a bottom portion. The lid portion may have an exterior cover and a bottom ring which are separated by a compression spring. Once extended protrusions on both the exterior cover and bottom ring of the lid are vertically aligned, a specific pressing and then twisting motion must be used to separate the lid from the bottom portion to gain access to the interior of the container. The bottom portion may receive contents such as medication which may be securely stored and protected from children who might otherwise access an unprotected and unsecured container.

Containers with security locks are known. For example, U.S. Pat. No. 9,481,496 to Cottle discloses a child resistant container for nicotine products. The container comprises latching elements adapted to interlock with cooperating latching elements when said lid is pushed onto a said base to retain said lid to said base. The latching elements are further adapted to disengage from said cooperating latching elements when a simultaneous force is exerted on all releasable latching arrangements by two hands of a user or the like.

Further, U.S. Pat. No. 9,187,220 to Biesecker discloses a cap having a top wall, an outer peripheral edge, a first section, and a second section. A skirt depends from the outer peripheral edge. The skirt includes an attached end, a free end, a plurality of slots, and a plurality of apertures. Each aperture is spaced-apart from the free end of the skirt. The top wall has a first configuration and a second configuration. When the top wall is in the first configuration, the first section is generally planer and the second section is generally arcuate. When the top wall is in the first configuration, the skirt extends generally perpendicularly to the first section to generally engage at least a portion of a container. When the top wall is in the second configuration, the free end of the skirt extends radially outwardly from the attached end thereof to allow the cap to be removed from the container.

Still further, U.S. Pat. No. 8,931,657 to Kientzle discloses a pharmaceutical container having a bottle having a bottom wall and side walls. A ridge proximate to the bottom wall projects from an interior surface of at least one of the side walls, to facilitate nested stacking of a plurality of bottles. One or more of the side walls includes a cover locking receptacle proximate to the top end of the side wall. The pharmaceutical container also includes a cover including a sliding lid contained in a cover housing. The cover housing has a top wall, which includes an opening, and cover side walls. A child-resistant closure mechanism is also provided to limit the movement between the sliding lid and the bottle.

However, these patents fail to describe a container with a security lock which is easy to use. Further, these patents fail to provide for a container with a security lock which allows a user to unlock a child-resistant container in a simple and safe manner.

SUMMARY OF THE INVENTION

A container with a security lock is provided. The container may have a lid (or "top") portion and a bottom portion. The lid portion may have an exterior cover and a bottom ring which are separated by a compression spring. Once extended protrusions on both the exterior cover and bottom ring of the lid are vertically aligned, a specific pressing and then twisting motion must be used to separate the lid from the bottom portion to gain access to the interior of the container. The bottom portion may receive contents such as medication which may be securely stored and protected from children who might otherwise access an unprotected and unsecured container.

An advantage of the present child resistant storage container is that the present child resistant storage container is suitable for seniors which typically have difficulty opening typical child resistant containers.

And another advantage of the present child resistant storage container is that the present container keeps the contents of the container secure and dry in a moisture-resistant manner.

Still another advantage of the present child resistant storage container is that the present container lacks exterior sharp edges and corners which may otherwise injure someone.

For a more complete understanding of the above listed features and advantages of the container with a security lock reference should be made to the detailed description and the drawings. Further, additional features and advantages of the invention are described in, and will be apparent from, the detailed description of the preferred embodiments.

DETAILED DESCRIPTION OF THE PREFERRED EMBODIMENTS

A container with a security lock is provided. The container may have a lid (or "top") portion and a bottom portion. The lid portion may have an exterior cover and a bottom ring which are separated by a compression spring. Once extended protrusions on both the exterior cover and bottom ring of the lid are vertically aligned, a specific pressing and then twisting motion must be used to separate the lid from the bottom portion to gain access to the interior of the container. The bottom portion may receive contents such as medication which may be securely stored and protected from children who might otherwise access an unprotected and unsecured container.

Figure 1:
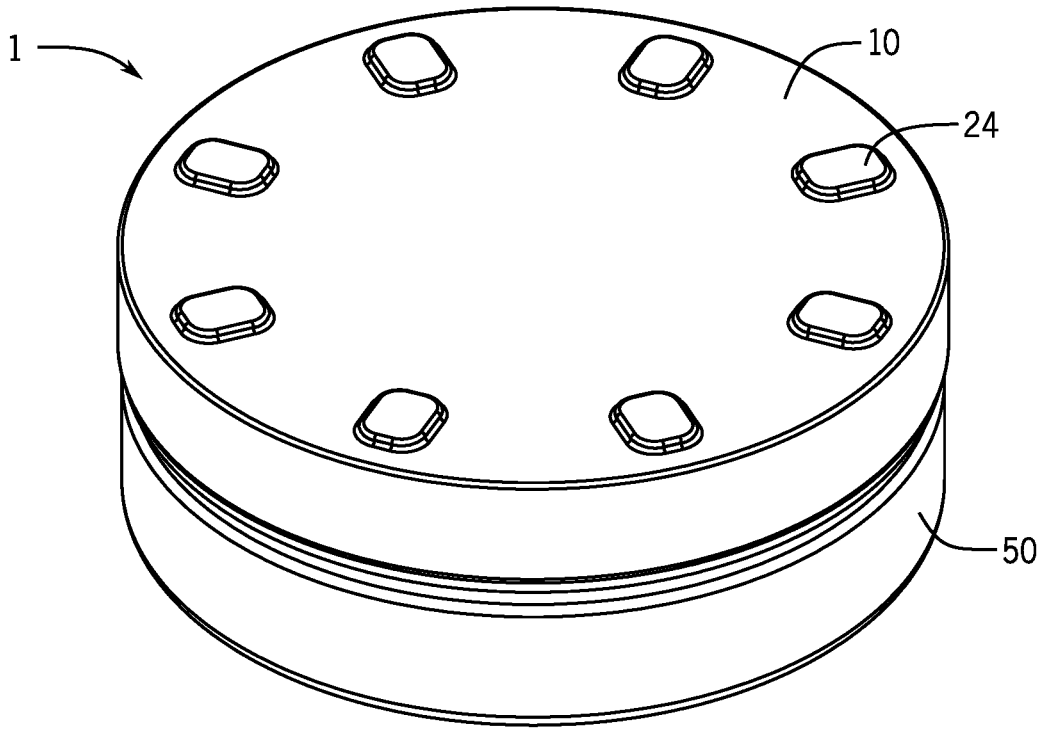
FIG. 1 illustrates a perspective top view of a first embodiment of the container with a security lock wherein the lid (or 'top') portion is secured to the bottom portion in the closed orientation.
Figure 2:
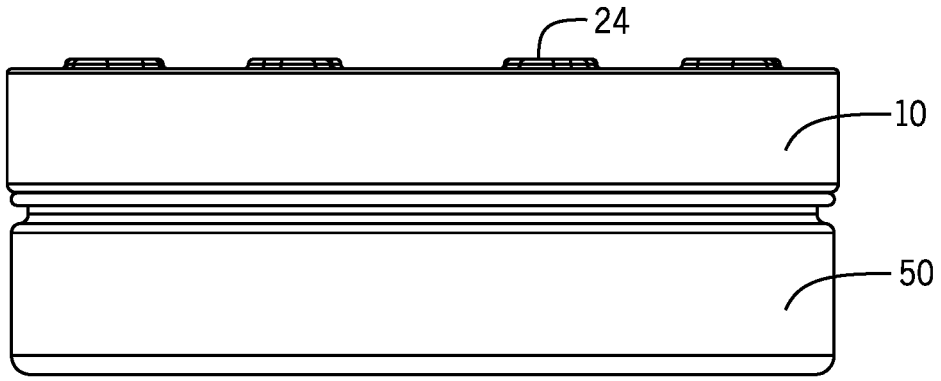
FIG. 2 illustrates a side view of the first embodiment of the container with a security lock wherein the lid portion is secured to the bottom portion in the closed orientation

Referring first to FIGS. 1 and 2, in an embodiment a secured container 1 is provided. The container 1 may have a lid (or "top") portion 10 and a bottom portion 50. The container 1 may be especially suitable for securing an item 100 (FIG. 4), such as medication, which can potentially be harmful to individuals, such as children, whom might otherwise gain access to the item (such as medicine) from a non-secure container. In an embodiment, the container 1 is largely made of a durable material, such as plastic and/or metal. In one embodiment, the container 1 is largely made of tin.

Figure 4:
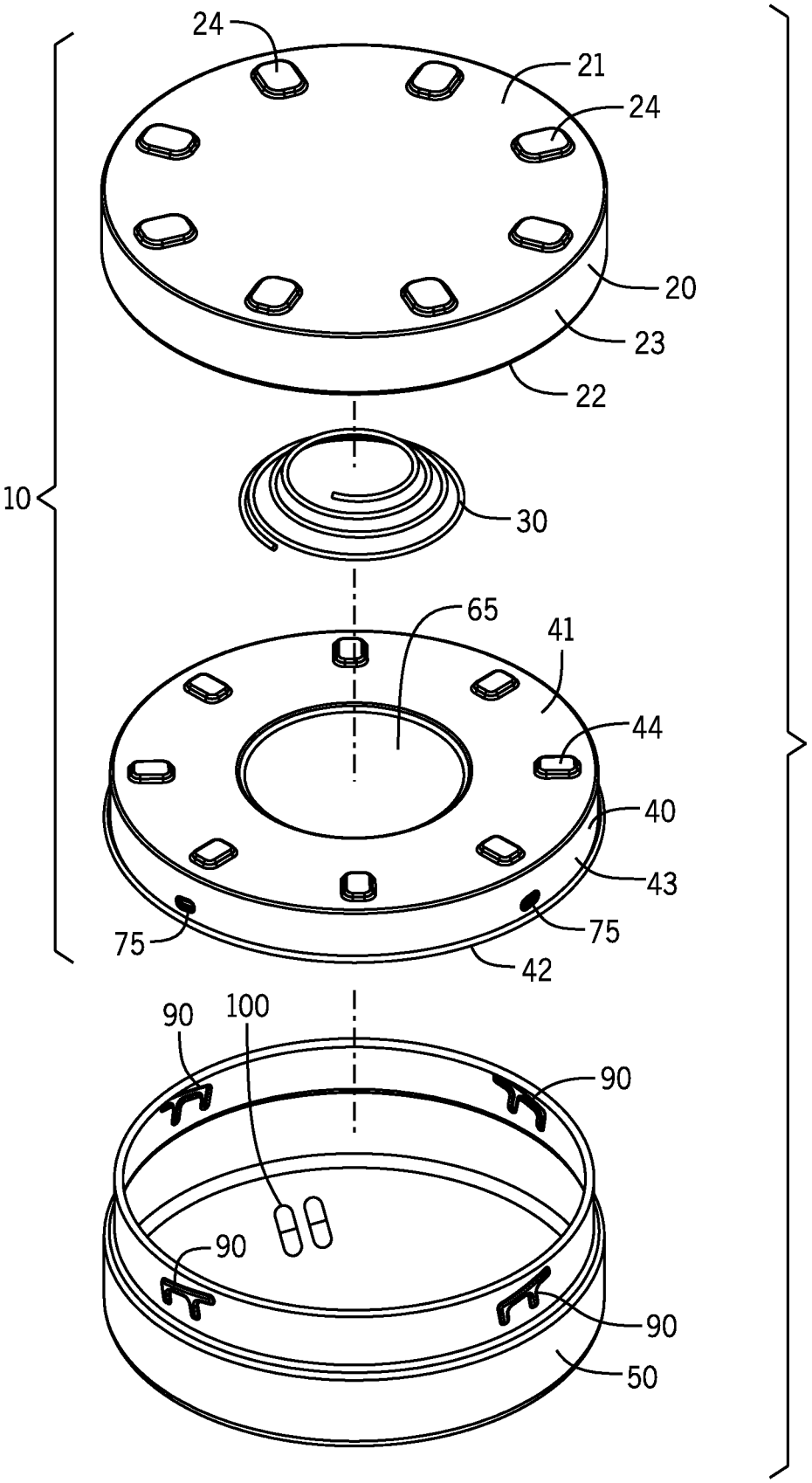
FIG. 4 illustrates an exploded perspective view of the first embodiment of the container with a security lock.
Figure 5:
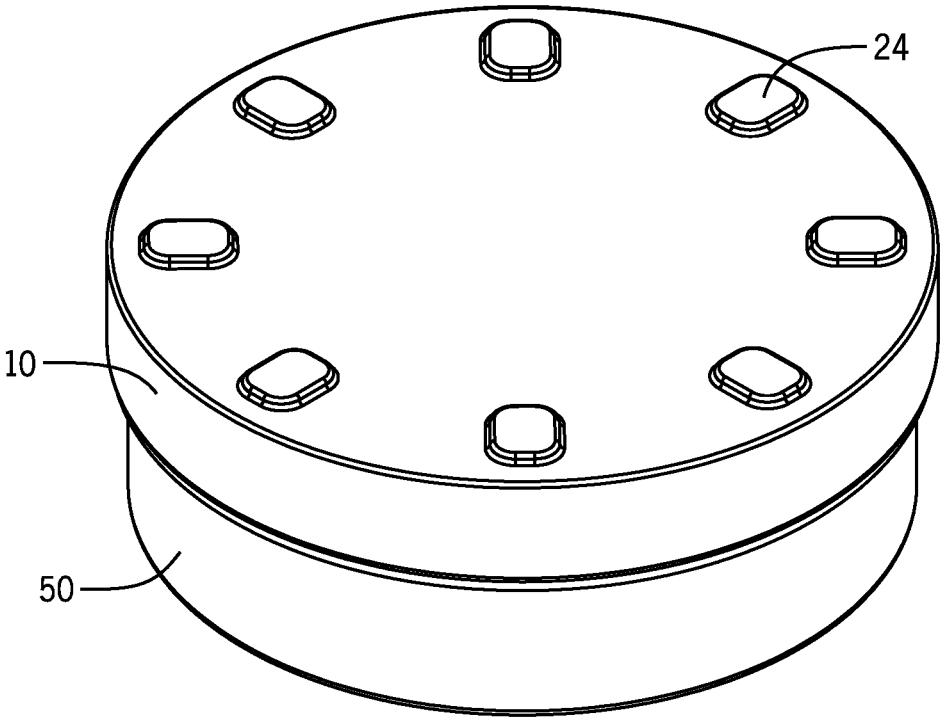
FIG. 5 illustrates a perspective side view of a second embodiment of container with a security lock wherein the lid portion is secured to the bottom portion in the closed orientation.
Figure 6:
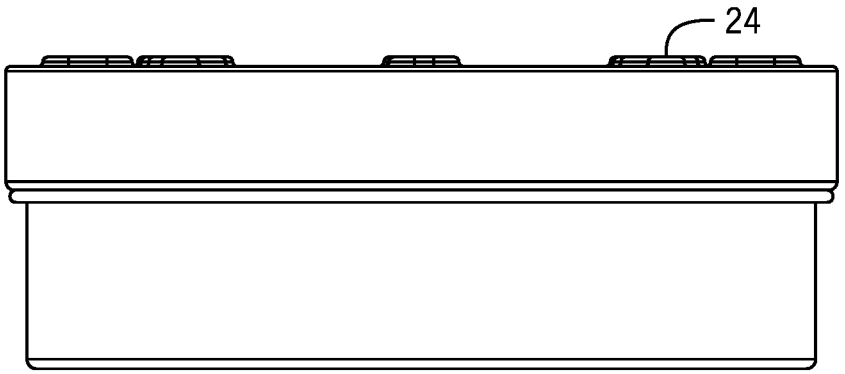
FIG. 6 illustrates a side view of the second embodiment of the container with a security lock wherein the lid portion is secured to the bottom portion in the closed orientation.
Figure 7:
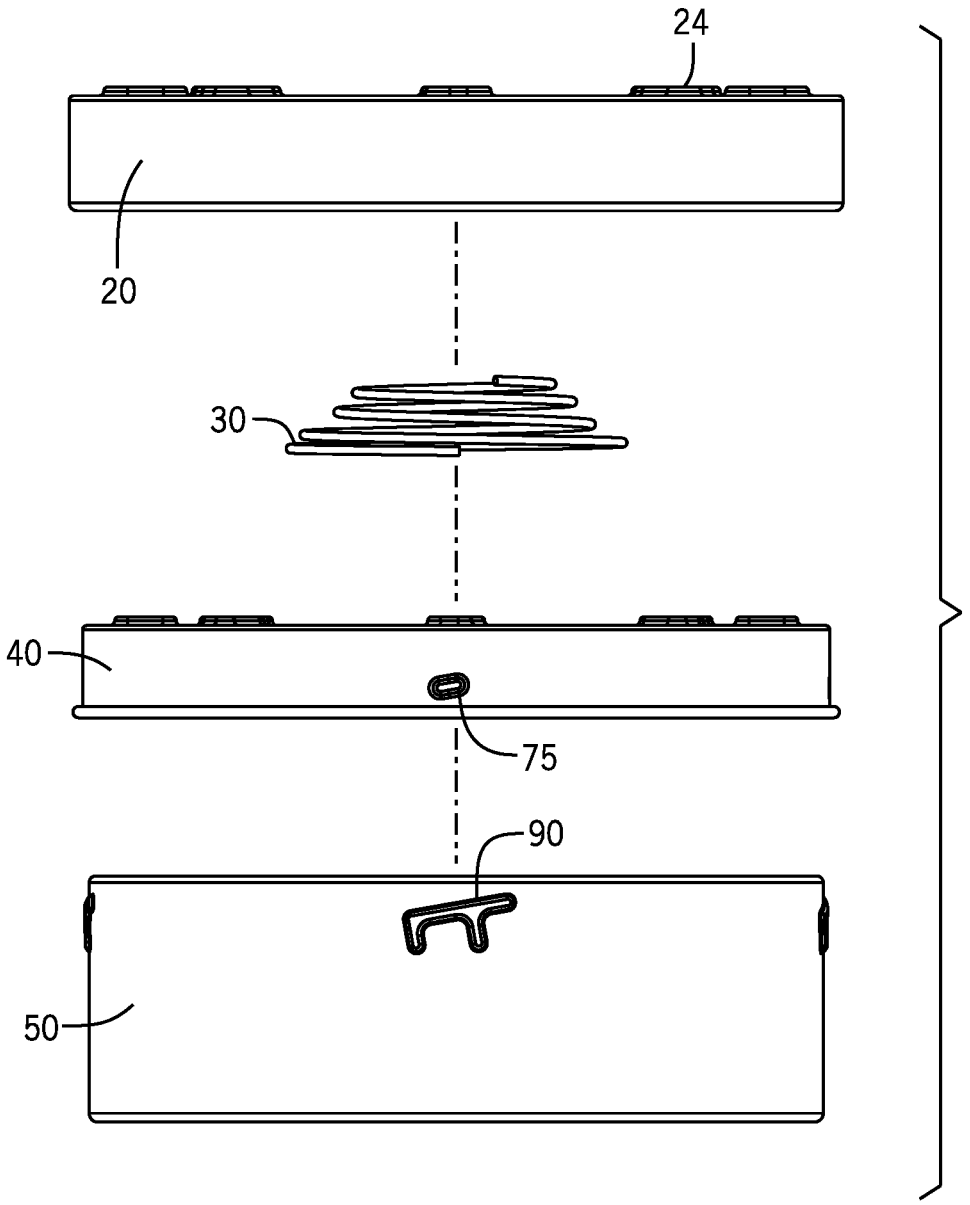
FIG. 7 illustrates an exploded side view of the second embodiment of the container with a security lock.
Figure 9:
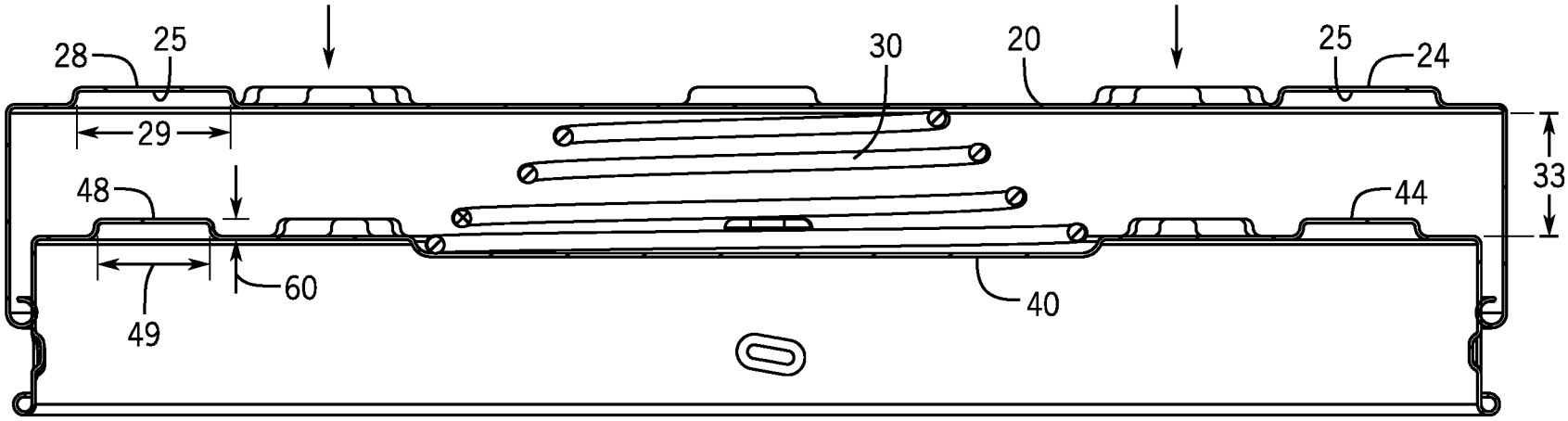
FIG. 9 illustrates a cross-sectional side view of the lid wherein the spring is not compressed and wherein the exterior cover of the lid is therefore not locked to the bottom ring of the lid and wherein the exterior cover of the lid may freely rotate with respect to the bottom ring of the lid.

Referring now to FIG. 4, in an embodiment, the lid portion 10 may be made of three different units which remain attached to each other. Specifically, the lid portion 10 may have an exterior cover 20, a spring 30 and a bottom ring 40. The exterior cover 20 may be the portion of the lid that is most visible to the user. The exterior cover 20 may have a top 21, a bottom rim 22 and a generally cylindrical side 23. The top 21 of the lid 10 may have a plurality of extended protrusions 24 which may be, for example, generally rectangular in shape. In an embodiment, the protrusions 24 are located at or near the perimeter of the exterior cover 20 for easier twisting of the lid 10 when the protrusions 24, 44 are aligned (as described below) The figures illustrate eight extended protrusions 24 on the exterior cover 20; however, a greater or fewer number of protrusions 24 may be used. An underside 25 of each of the extended protrusion 24 may have an upward indentation that may mirror the size, shape and location as the extended protrusions 24, as shown in FIG. 9. More specifically, the extended protrusions 24 may be hollow bumps on the exterior cover 20.

In an embodiment, the bottom ring 40 may have a plurality of extended protrusions 44 which surround an indented circular portion 65 having a diameter similar to or slightly larger than the diameter of the bottom of the spring 30. The indented circular portion 65 may receive and therein secure the spring 30 and may prevent the spring 30 from sliding or moving away from the center of the bottom ring 40 of the lid 10. In an embodiment, the same number (and location) of extended protrusions 24 which are located on the exterior cover 20 of the lid 10 are present on the bottom ring 40 of the lid 10. Further, a center point 28 (FIG. 9) of each of the extended protrusions 24 of the exterior cover 20 may be located directly above a center point 48 of the extended protrusions 44 of the bottom ring 40 of the lid 10 when the protrusions 24, 44 are aligned. In an embodiment, the protrusions 24 and 44 may be, for example, rectangular in shape, triangular or other shapes provided that the protrusions 24 of the exterior cover 20 of the lid 10 substantially match the protrusions 44 of the bottom ring 40 of the lid 10.

The bottom ring 40 of the lid 10 may resemble the exterior cover 20 of the lid 10, but may have slightly different dimensions. For example, an interior diameter 27 (FIG. 10) of the exterior cover 20 may be slightly greater than an interior diameter 47 of bottom ring 40 so that the bottom ring 40 may snuggly fit under the exterior cover 20. The bottom ring 40 may further have a top surface 41 (FIG. 4), a bottom lip 42 and a generally cylindrical side 43.

Figure 10:
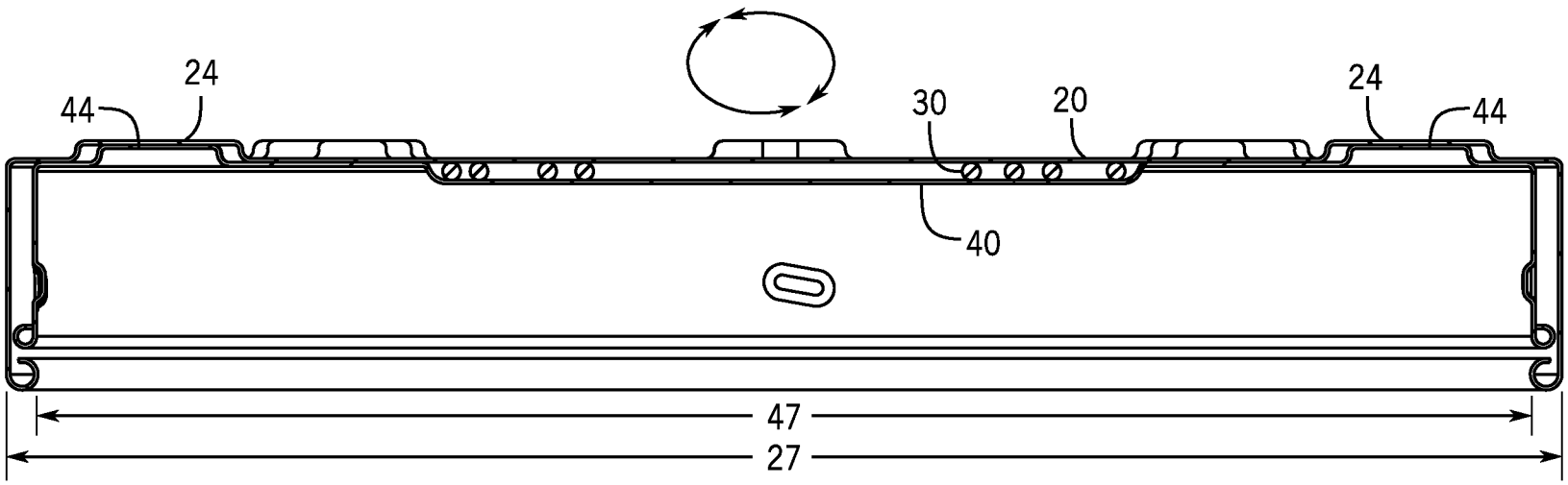
FIG. 10 illustrates a side cross-sectional view of the lid wherein the compression spring is compressed and wherein the protrusions of the exterior cover of the lid and the protrusions of the bottom ring of the lid are aligned with each other and therefore the exterior cover of the lid is locked to the bottom ring of the lid portion and therefore the exterior cover and bottom ring of the lid portion may therein rotate in unison.

In an embodiment, an interior diameter 29 of the extended protrusion 24 of the exterior cover 20 may be slightly greater than an interior diameter 49 of the extended protrusion 44 of the bottom ring 40 so that the extended protrusion 44 of the bottom ring 40 may partially fit within the underside 25 of the extended protrusion 24 of the exterior cover 40 when the exterior cover 20 and the bottom ring 40 are locked together in FIG. 10.

Located between the exterior cover 20 and the bottom ring 40 may be the spring 30. The spring 30 may be generally cylindrical and may be placed between the exterior cover 20 and the bottom ring 40 without being physically secured to either. As a result, the exterior cover 20 and bottom ring 40 may rotate with respect to each other. As stated above, the spring 30 may rest in the indented portion 65 of the bottom ring 40. As a result, the exterior cover 20 may freely rotate three hundred and sixty degrees with respect to the bottom ring 40 when the spring 30 forces the exterior cover 20 away from the bottom ring 40, as shown in FIG. 9. The spring 30 may have a height 33, which, while in the resting state as shown in FIG. 9, is greater than a height 60 of the extended protrusion 44 of the bottom ring 40. When the spring 30 is compressed, the height of the spring 30 becomes less than the height 60 of the extended protrusion 44 of the bottom ring 40 (or at least the spring 30 may have a lower overall height surface than the extended protrusion 44 of the bottom ring 40 while the spring 30 is compressed and resting in the circular indentation portion 65).

More specifically, the exterior cover 20 may rotate three hundred and sixty degrees with respect to the bottom ring 40 as a result of the extended protrusions 44 of the bottom ring 40 not contacting the underside 25 of the extended protrusion 24 of the exterior cover 20. Therefore, when a user manually twists the exterior cover 20 while the spring 30 is expanded (as shown in FIG. 9) the extended protrusions 44 of the bottom ring 40 to not catch any portion of the exterior cover 20.

When a user first applies downward pressure on the top 21 of the exterior cover 20, the spring 30 is compressed. When the spring 30 is compressed a user may have to slowly twist the exterior cover 20 until the extended protrusions 44 of the bottom ring 40 then partially slide into the underside 25 of the corresponding protrusions 24 of the exterior cover 20 (as shown in FIG. 10). When this happens, the twisting of the exterior cover 20 therein also twists the bottom ring 40 in unison.

When the bottom ring 40 and the exterior cover 20 of the lid 10 are twisted in unison, a protrusion 75 located on the interior surface of the side 43 of the bottom ring 40 turns (along with the bottom ring 40 itself). For illustrative purposes, the figures illustrate the protrusions 75 as if the side 43 of the bottom ring 40 were to be transparent. If the side 43 of the bottom ring 40 were not transparent, the protrusions 43 would not be visible from the perspective shown in the Figures, but would only be visible from the underside of the bottom ring 40. The protrusions 43 must face inward so that they can interact with the catch devices 90 as described below.

Figure 3:
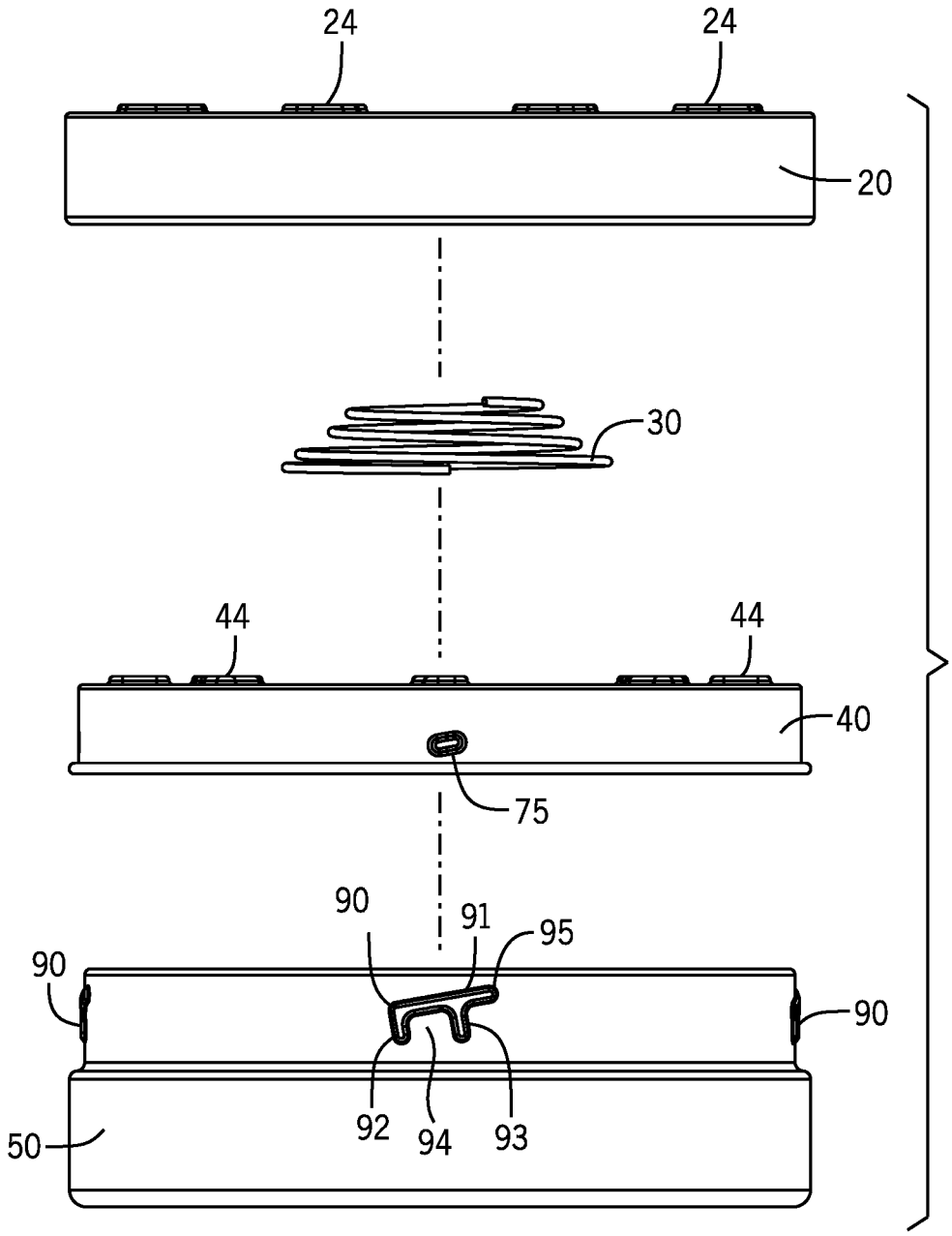
FIG. 3 illustrates an exploded side view of the first embodiment of the container with a security lock.
Figure 8:
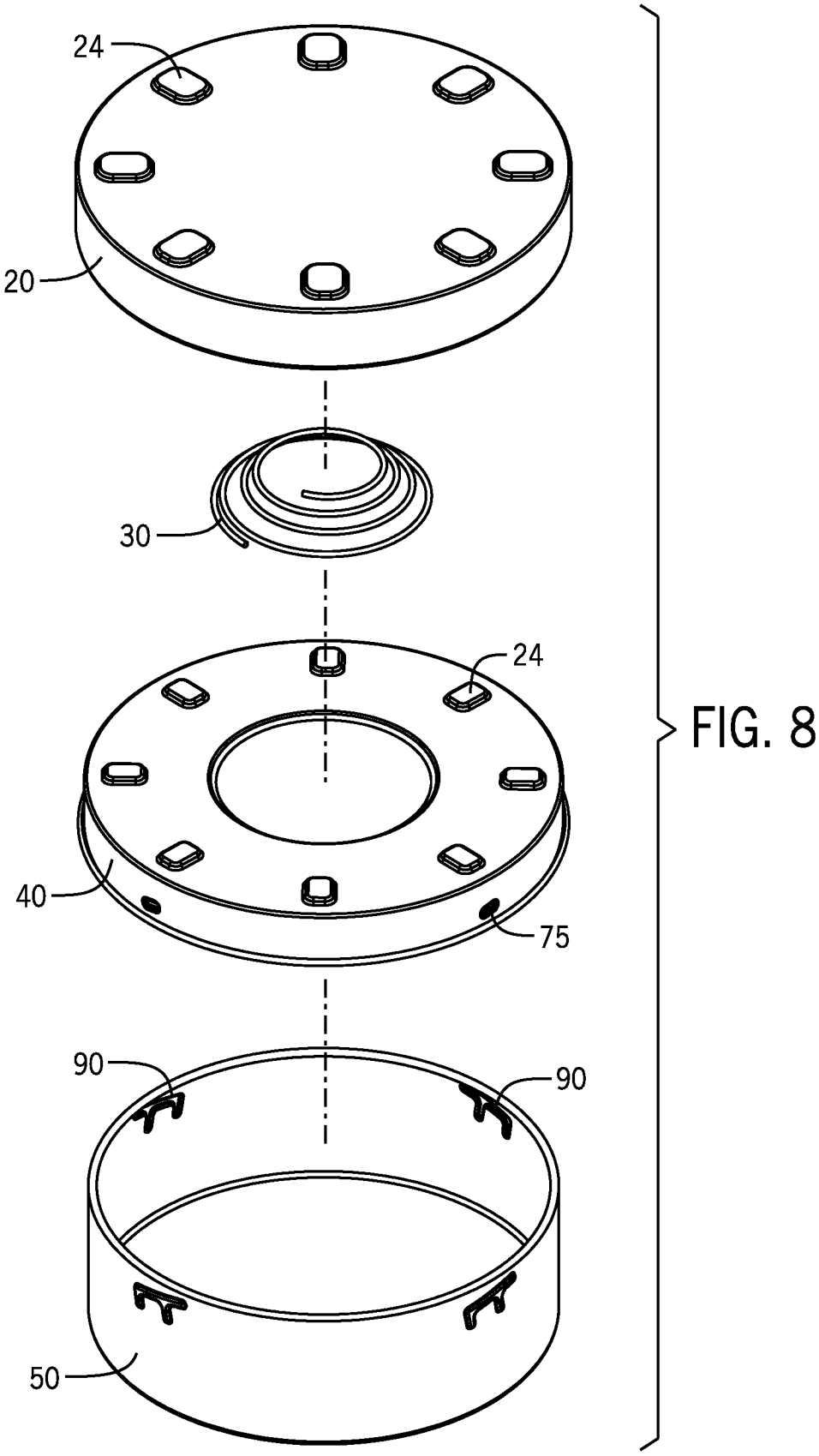
FIG. 8 illustrates an exploded side view of the second embodiment of the container with a security lock.

In an embodiment, the protrusion 75 may be slightly slanted upward as shown in FIG. 3. The protrusion 75 may then interact with a catch device 90 (or 'securing mechanism') located on the bottom portion 50 of the container 1. The catch device 90 may be a generally u-shaped inverted device. In an embodiment, the catch device 90 may have a top surface 91 which is slanted and a first prong 92 and a second prong 93 which, together, form a pocket 94. In an embodiment, the slant of the protrusion 75 may largely mirror the slant of the catch device 90. In an embodiment, the container 1 may have multiple protrusions 75 and multiple catch devices 90, as is shown in FIG. 4. For illustrative purposes, FIGS. 4 and 8 show all four catch devices 90 as if the top rim of the bottom unit 50 were to be transparent. If the top rim of the bottom unit 50 is not transparent then you would not see the top two catch devices 90 in FIGS. 4 and 8 from that perspective, but would only see the front two catch devices 90.

Located on the exterior side of the second prong 93 may be an extended flange 95 which may catch the protrusions 75 when the top portion 10 is twisted. Once a protrusion 75 contacts the outside of the catch device 90 (just to the right of the second prong 93) a user may push the lid 10 down even further so that the protrusions 75 move slightly downward even farther with respect to the catch device 90 and then, when pressure is released as the lid 10 is slightly turned to the left, the protrusion becomes temporarily locked in the pocket 94 of the catch device 90 and remains there until the user decides to open the container 1 my pushing down on the lid 10, slightly twisting the lid 10 and releasing the protrusion 75 form the catch device 90.

Figure 11:
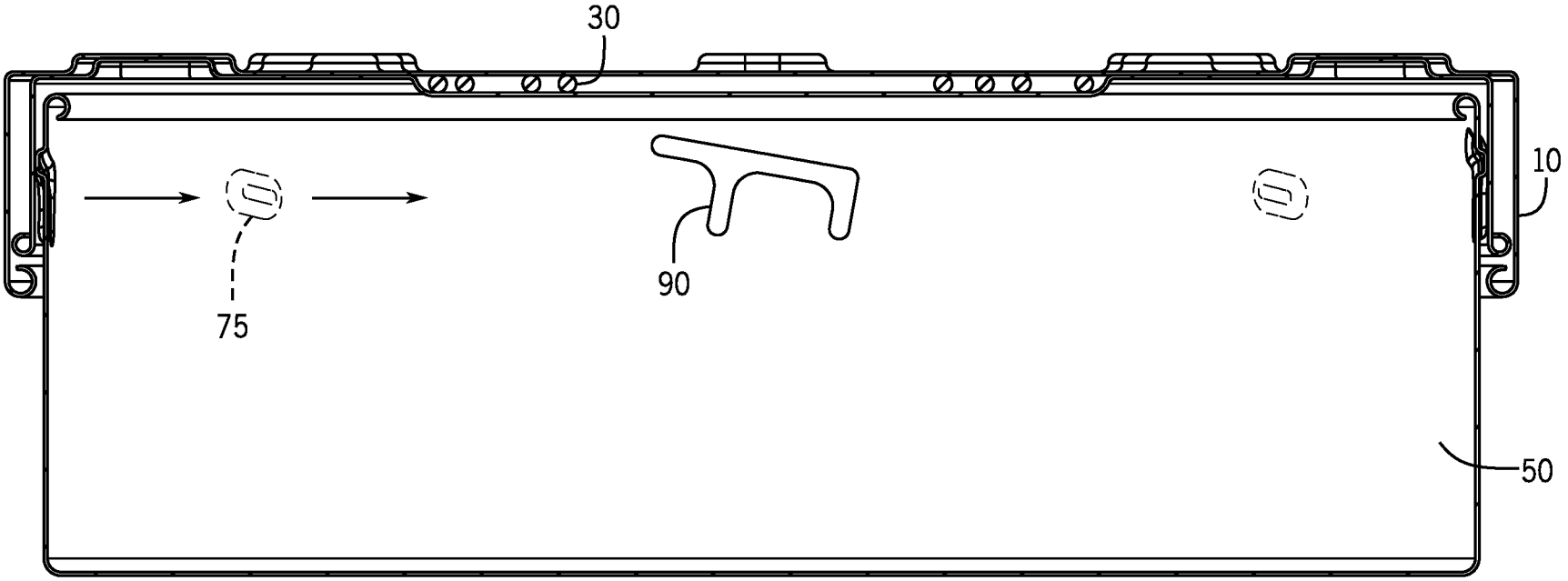
FIG. 11 illustrates a cross-sectional side view of the lid portion of the container located on the bottom portion of the container and wherein the side protrusions of the lid portion are not yet locked into the catch devices of the bottom portion of the container and therefore the lid may be removed from the bottom portion.
Figure 12:
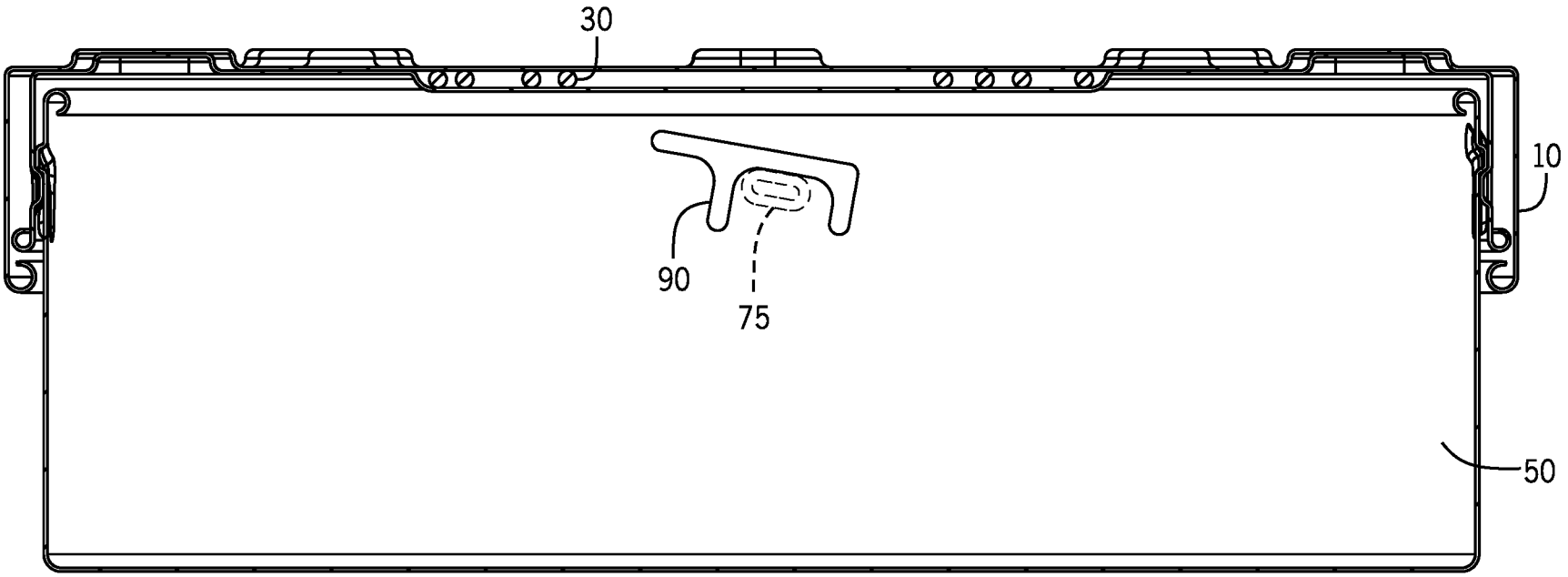
FIG. 12 illustrates a cross-sectional side view of the lid portion located on the bottom portion wherein the side protrusions of the lid are locked into the catch devices of the bottom portion and wherein the container is therein locked.

Referring now to FIGS. 11 and 12, the lid 10 is shown placed on the bottom portion 50 of the container 1 (in a cross sectional view) while the lid 10 is in the process of being rotated, but is not yet locked into the catch device 90 of the bottom portion 50 of the container 1. When the top portion 10 is rotated further, the protrusion 75 of the lid 10 gets caught and locks into the catch device 90 of the bottom portion 50 and therein locks the lid 10 to the bottom portion 50 (as shown in FIG. 12) when the lid 10 is pushed down and slightly twisted.

To release the lid 10 from the bottom portion 50, a user presses down on the top 21 of the exterior cover 20 of the lid 10 and therein compresses the spring 30. The protrusion 75 of the bottom ring 40 then gets pushed out of the pocket 94 of the catch device 90 of the bottom ring 40 and the lid 10 may then be rotated with respect to the bottom portion 50 and the lid 10 may therein be removed from the bottom portion 50. In order to rotate the exterior cover 20, as stated above, the protrusions 24 of the exterior cover 20 must be located within the extended protrusions 44 of the bottom ring 40 of the top portion 10.

In an embodiment, the lid 10 may have a curled, inward-rolled edge so that the container 1 is smooth and forms an air-tight seal with the container is sealed. This may increase safety, reduce air and contaminants from contacting the contents 100 of the container 1 and may also increase the appearance of the container 1. Finally, in one embodiment, the lid 10 and the bottom portion 50 may be slightly magnetically attracted to each other so as to form a greater seal.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

I claim:

1. A container with a security lock comprising:

a lid having an exterior cover, a bottom ring and a spring located between the exterior cover and the bottom ring;

a bottom portion having an interior wherein the lid is removably secured to the bottom portion;

a protrusion located on a side of the bottom ring of the lid wherein the protrusion of the side of the bottom ring is temporarily and removably secured within a securing mechanism located on a side of the bottom portion of the container in order to lock the lid of the container to the bottom portion of the container; and wherein the protrusion of the side of the bottom ring has an angled flat top surface and therein the securing mechanism is an inverted u-shaped device having a first prong, a second prong and an angled top surface.

2. The container with a security lock of claim 1 further comprising:

an indentation portion located on a top of the bottom ring of the lid wherein the indentation portion has a diameter which is at least as large as a diameter of the spring.

3. The container with a security lock of claim 1 further comprising:

at least one protrusion located a top of the exterior cover of the lid and at least one protrusion located on a top of the bottom ring of the lid.

4. The container with a security lock of claim 3 further wherein the protrusion of the bottom ring is smaller in size than the protrusion of the exterior cover of the lid.

5. The container with a security lock of claim 3 wherein the spring must be compressed and wherein the protrusion of the bottom ring of the lid must be aligned with and partially located within the protrusion of the exterior cover of the lid in order to rotate the exterior cover and the bottom ring of the lid in unison.

6. The container with a security lock of claim 1 wherein the spring has a compressed height and a non-compressed height and wherein the height of the spring is greater than a height of an extended protrusion located on a top of the bottom ring when the spring is not compressed.

7. The container with a security lock of claim 1 wherein an air-tight seal is created between the lid and the bottom portion when the lid is secured to the bottom portion.

8. The container with a security lock of claim 1 wherein the lid portion is at least partially magnetic.

9. The container with a security lock of claim 1 wherein the exterior cover, the bottom ring and the spring are permanently secured together.

10. A container with a security lock comprising:

a lid having an exterior cover, a bottom ring and a spring located between the exterior cover and the bottom ring;

a bottom portion having an interior wherein the lid is removably secured to the bottom portion; and at least one protrusion located a top of the exterior cover of the lid and at least one protrusion located on a top of the bottom ring of the lid.

11. The container of claim 10 wherein the protrusion of the bottom ring is smaller in size than the protrusion of the exterior cover of the lid.

12. The container with a security lock of claim 10 wherein the spring must be compressed and wherein the protrusion of the bottom ring of the lid must be aligned with and partially located within the protrusion of the exterior cover of the lid in order to rotate the exterior cover and the bottom ring of the lid in unison.

13. The container with a security lock of claim 10 wherein the spring has a compressed height and a non-compressed height and wherein the height of the spring is greater than a height of an extended protrusion located on a top of the bottom ring when the spring is not compressed.

* * * * *